United States Patent [19]

Guerra

[11] 4,068,672

[45] Jan. 17, 1978

[54] METHOD AND APPARATUS FOR BREAKING THE HABIT OF SMOKING

[75] Inventor: Romeo E. Guerra, Dallas, Tex.

[73] Assignee: Alfohn Corporation, Irving, Tex.

[21] Appl. No.: 643,514

[22] Filed: Dec. 22, 1975

[51] Int. Cl.[2] ..... A24F 15/06

[52] U.S. Cl. ..... 131/170 A; 131/178

[58] Field of Search ..... 131/170 A, 178, 170 R, 131/171 A; 128/404, 409; 231/2 E

[56] References Cited

U.S. PATENT DOCUMENTS

| | | | |
|---|---|---|---|
| 1,158,473 | 11/1915 | Floyd | 231/2 E |
| 3,482,580 | 12/1969 | Hollabaugh | 131/178 |
| 3,885,576 | 5/1975 | Symmes | 131/170 A |
| 3,886,953 | 6/1975 | Pope | 131/170 A |
| 3,889,163 | 6/1975 | Symmes | 131/170 A |

*Primary Examiner*—Stephen C. Pellegrino
*Attorney, Agent, or Firm*—Charles W. McHugh

[57] ABSTRACT

A device having utility in interfering with a person's desire to hold an object such as a cigarette, cigar or pipe, between his lips, i.e., an anti-smoking device. In the form of a cigarette holder, it includes a generally tubular shell having first and second ends, with the first end being adapted to receive a cigarette; the second end thereof includes structure adapted to be held between a person's lips. A DC voltage source (such as a dry cell battery) of at least six volts and preferably nine volts is mounted within the shell. First and second electrically conductive members are connected to the output of the DC source, with the distal ends of said conductive members extending alongside the lip-contacting structure so that they may be readily touched by a person's lips. The distal ends of said conductive members are separated so as to form a normally open electrical path, such that placing the lip-contacting structure between a person's lips will instantaneously close the electrical path and result in the discharge of DC current from said source through the lips. A potentiometer is optionally provided to adjust the flow of current from a minimum of about one milliamp (in order to be discernable) to a maximum of about five milliamps (so as to avoid intolerable sensations). Additionally, means are disclosed for re-charging a battery which is permanently mounted within the shell of a cigarette holder or the like.

3 Claims, 14 Drawing Figures

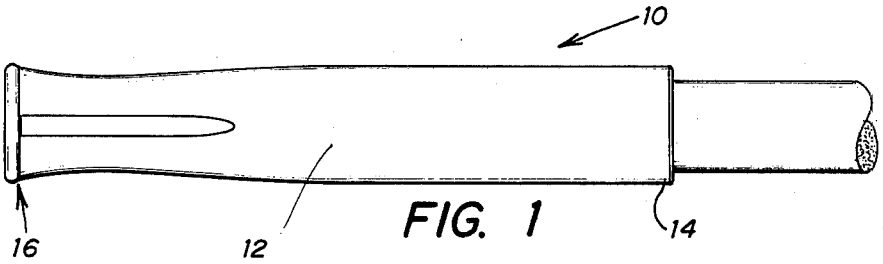
FIG. 1
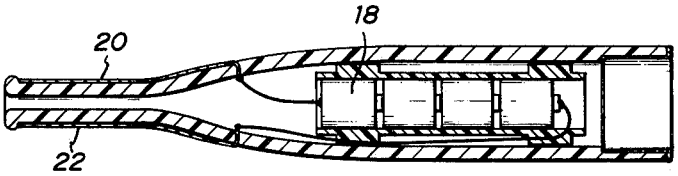
FIG. 2
FIG. 3
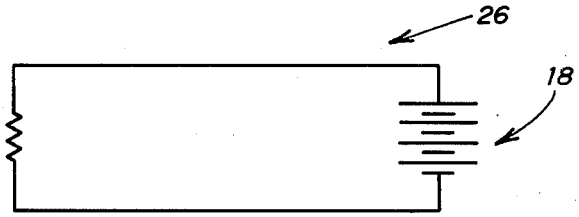
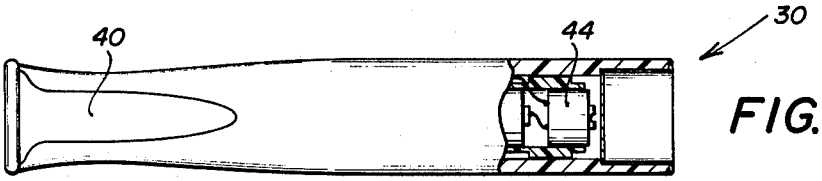
FIG. 4
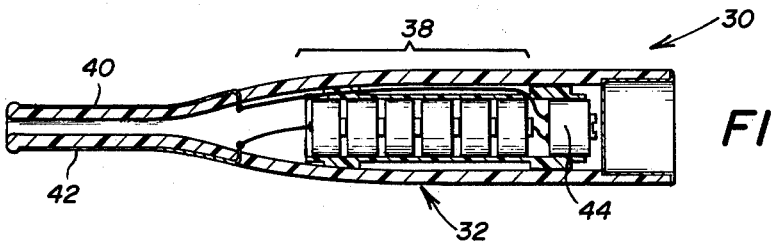
FIG. 5
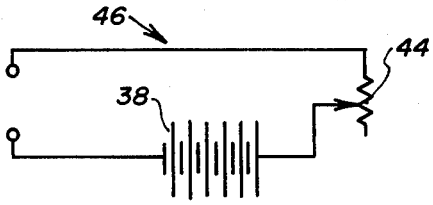
FIG. 6A
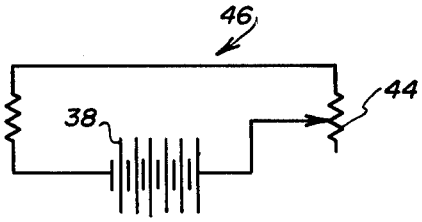
FIG. 6B
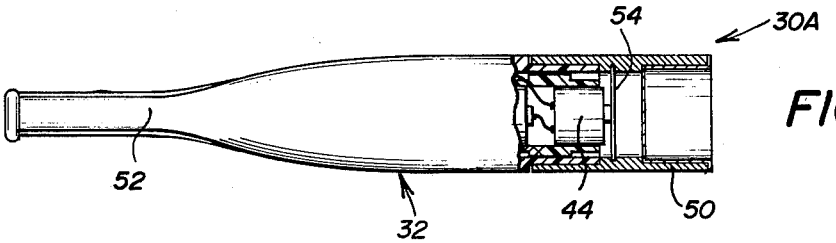
FIG. 7

METHOD AND APPARATUS FOR BREAKING THE HABIT OF SMOKING

This invention relates to a method and device for assisting a smoker in his attempts to break the habit of smoking.

It is now recognized by many people that smoking appears to be somewhat hazardous to a person's health, and many reputable authorities have urged those people who presently smoke to cease such smoking. Regrettably, even though a habitual smoker might tentatively agree to stop, the force of habit frequently causes him to continue in a course of conduct that may have been established over a period of many years. And, as might be expected, it is not easy to quickly break a habit that perhaps took many years to establish.

Apart from mere moral encouragement, there have been devices proposed that address themselves to the general problem of helping smokers to break the habit. For example, U.S. Pat. No. 3,482,580 to Hollabaugh discloses an anti-smoking device which is adapted to produce an AC electrical shock at times when smoke is drawn through an internal passage in a cigarette holder or the like. However, there are some characteristics of the Hollabaugh device which would render it less than satisfactory for certain uses. For example, the Hollabaugh device uses a sliding switch that is positioned in a cavity through which cigarette smoke passes. If the smoke contains an ordinary amount of tars and the like, there is a risk that such tars and residues will soon cause the interior of the cavity to become so fouled and "gummy" as to render the sliding switch immovable. It is an object of the present invention, therefore, to obviate the problems that are inherent with anti-smoking devices of the Hollabaugh type (having moving parts) by eliminating any parts that rely on movement for their operation. In some respects, then, this invention may be categorized as an "improvement" over the Hollabaugh patent.

In other respects, however, this invention should be recognized as being a substantial departure from the Hollabaugh patent, in that this invention operates upon a basic principle of rendering an electrical stimulus to a smoker instantaneously upon placing an object (such as a cigarette holder) between his lips—rather than waiting until he has lit the cigarette and/or taken a draw on it. A fundamental premise upon which the invention is based is the conclusion, based upon substantial research, that smoking is sub-consciously habit forming. Thus, some acts of smoking are founded upon a sub-conscious desire to satisfy a nicotine requirement that the body has; and, the only way that this sub-conscious desire can be effectively dealt with is to bring to a level of full awareness the sub-conscious desire to light up a cigarette. Hence, it is an object of this invention to quickly make a person realize that he is about to light up a cigarette, before he has done so. By bringing him into a state of conscious awareness of what he is doing, he is provided with an opportunity to over-ride his sub-conscious desire to smoke—if he chooses to. But even if he elects to go ahead and light that particular cigarette, he is still reminded (every time he places the holder between his lips) that he has established a goal of breaking his habit of smoking.

It is another object of the invention to provide a cigarette holder, pipe, etc., which has a self-contained source of electrical energy which is rechargeable.

Still another object is to provide an anti-smoking device characterized by simplicity and reliability, in that it has no moving parts.

A further object is to provide a simple means for adjusting the current which flows from a source of electrical energy when the device is placed between a person's lips. By providing an adjustable current flow, it is possible to take into account the variation in sensitivity between lips of different persons.

These and other objects will be apparent from a reading of the specification and claims appended thereto, with appropriate reference to the accompanying drawing in which:

FIG. 1 is a top view of an anti-smoking device which is fabricated in the shape of a cigarette holder.

FIG. 2 is a side elevational view, in cross section, of the cigarette holder shown in FIG. 1.

FIG. 3 is a schematic electrical diagram illustrating the circuit for the cigarette holder of FIG. 1.

FIG. 4 is a top, plan view of another embodiment of a cigarette holder.

FIG. 5 is a side, elevational view, in cross section, of the cigarette holder of FIG. 4.

FIGS. 6A and 6B are schematic electrical diagrams showing a circuit of the device of FIG. 5, with a person's lips being illustrated as a resistance of 2000 ohms and closing the normally open circuit.

FIG. 7 is an alternate embodiment of a cigarette holder wherein the current level is adjustable with a potentiometer.

Figure 8:
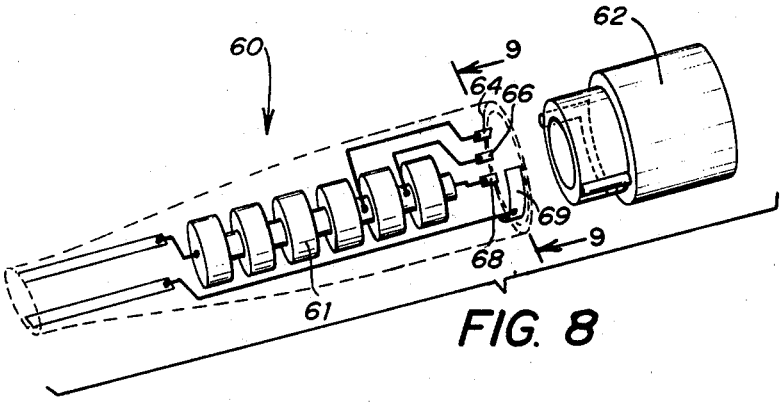
FIG. 8 is a perspective view of the electrical portion of another embodiment of the anti-smoking device.

Referring initially to FIGS. 1 and 2, an anti-smoking device 10 is shaped in the form of a conventional cigarette holder having a generally tubular shell 12 with a first end 14 and a second end 16. The first end 14 is adapted to receive a tobacco-holding object, such as a cigarette. The second end 16 includes structure which is so shaped that it is easily held between a person's lips. Mounted within the tubular shell 12 is a DC voltage source 18 which typically will be a battery. A satisfactory voltage source 18 is a plurality of batteries which are normally used in hearing aids, such as the number S13E batteries manufactured by Union Carbide Corporation; these are 1.5 volt silver oxide batteries. By arranging at least four of such 1.5 volt batteries in series, a voltage source of six volts is obtainable. This is important because it has been determined that at least six volts DC is necessary to provide sufficient electrical stimulus (shock) in order to make an appropriate impression upon the person using the device. While six volts DC has been found to be adequate, a preferred voltage is nine volts; thus, six serially arranged S13E batteries (or their equivalent) are mounted in one preferred embodiment. At the present time, six of the S13E batteries typically weight about ¼ ounce and would occupy a space about 1¼ inch long and 0.3 inch in diameter. Hence, the weight of six such batteries and the attendant electrical conductors which complete the device would add only about ¼ ounce to the weight of a conventional cigarette holder. Since some common cigarette holders—without the anti-smoking apparatus—weigh as much as ½ ounce, the modified cigarette holder as disclosed herein should be readily tolerable by a smoker, as far as its weight is concerned.

Also forming an integral part of the device 10 are first and second electrically conducting members 20, 22 which are mounted on opposite sides of the non-conductive shell 12. The members 20, 22 are connected internally to the output of the DC source 18, and they extend exteriorly of the shell 12 in the vicinity of the lip-contacting region. The distal ends of the conducting members 20, 22 are separated so as to form a normally open electrical path. Placing the lip-contacting end 16 between a person's lips should instantaneously close said electrical path, and result in the immediate discharge of current from said DC source 18 through the lips. The complete electrical circuit is shown diagrammatically in FIG. 3, with the person's lips indicated as a resistance of about 2000 ohms. Since there is no switch to fail, and no moving part in the device 10, it is characterized by great reliability—and it is effective in accomplishing one of the desired results instantaneously upon contact with a person's lips. That is, the device 10 will make a person immediately aware that he is involved in the smoking ritual, even though he might previously have been absent-mindedly getting prepared to light another cigarette.

While the device 10 is inherently capable of a rapid response to being placed between a person's lips, the current flow will not cause any inadvertent discomfort if a person's finger should accidentally bridge the gap between the two distal ends of the conductors 20, 22—because the relatively low flow of current through the circuit will normally not even be discernable through a person's fingers. It has been found that a minimum flow of DC current in order to be discernable by a person's lips should be at least 1 milliamp; and, it would be unusual for an average person to be able to casually tolerate in excess of 5 milliamps. Hence, the optimum range of current that should be provided by the circuit 26 should be within the range of about 1–5 milliamps.

Referring next to FIGS. 4 and 5, an alternate embodiment of the invention includes a device 30 which, like device 10, has the configuration of a cigarette holder. The holder 30 has a generally tubular shell 32 which is preferably integrally molded around a source of electrical energy 38, which is shown as six batteries mounted in series; each battery is rated at 1.5 volts—so as to achieve the preferred voltage rating of nine volts. On the top of the holder 30 and near the lip-contacting region is a first, relatively flat electrically conductive member 40. On the bottom of said device 30 is another relatively flat electrically conductive member 42. Both of these conductive strips 40, 42 are preferably made of non-oxidizing material (such as stainless steel) so that there will not be any appreciable risk of ingestation of oxide particles—if the device 30 is used for an extended period of time.

In order to foster an optimized sensation in the lips, the two electrically conducting members 40, 42 should be at least ⅛ inch wide in the vicinity of the lip-contacting region. A more narrow member, such as a mere wire, has been found to sometimes concentrate the flow of electricity in too small an area, with the result that a skin aberation almost like a blister can sometimes be produced. Also, it has been found that the over-all sensation from the electrical discharge seems to be reduced when the area through which current is passed is concentrated in an area that is too small. While a width of ⅛ inch in the electrically conducting members 40, 42 is generally satisfactory, a preferred width is about ¼ inch. And, since the length of that portion of the electrically conducting members 40, 42 which is actually in contact with a lip during the act of smoking will typically be about ½ inch, then the lip-contacting area of each of the electrically conducting members will be at least 0.06 square inch (i.e., the product of ⅛ and ½ inch).

Also shown in FIG. 5 is an optional assessory to compensate for the fact that different persons do not always have the same sensitivity in their lips. This assessory is a potentiometer 44 which is mounted (for safety) within the shell 32, where it is not exposed to inadvertent changes as a result of being rubbed against another object, etc. As shown further in FIG. 6A, the electrical circuit 46 for this device 30 (in its passive mode) has an electrical path which is normally open. Hence, there is no power drain on the DC source 38, and the shelf life of the device 30 can be expected to be the same as the shelf life of a conventional battery. Placing the lip-contacting end of the device 30 between a person's lips will instantaneously close the electrical path, with a resistance that has been found to be about 2000 ohms, resulting in an immediate discharge of DC current from source 38. In this embodiment, as with the embodiment of FIG. 3, the polarity of the power source is immaterial, so that the batteries can be physically connected to the electrical conductors in any convenient manner. A suitable potentiometer for use with the holder 30 is a 5000 ohm "minipot" available from any of several major resistor suppliers, e.g., Ohmite, Celmet. Such potentiometers are commercially available with an external shell which is about ¼ inch in diameter; hence, they are readily adaptable to the space envelope which is available in a cigarette holder 30 that will not look any larger than those which are commercially available for filtering purposes, cosmetic appeal, etc. Such potentiometers 44 will typically have a slotted member which can be engaged by a small screwdriver from the front of the device 30, so as to effect the desired adjustment in resistance. A person who is not satisfied with the adjustment of the circuit 46 as it comes from the factory can make such adjustments as he deems desirable at any time. Of course, an optimum adjustment will be one that provides enough "tingle" to be discernable and to serve as a reminder when the holder is placed between a person's lips, but which does not provide so much of a "jolt" as to cause the smoker to completely avoid use of the holder. A main objective of the therapy program proposed herein is to inhibit a person's desire to hold a cigarette or pipe in his mouth—not to punish him for doing so.

In FIG. 7 another embodiment of the invention is shown which includes a holder 30A wherein a front portion 50 of the shell 32 is rotatable with respect to the shell's mouth portion 52. A structural pin 54 is provided to connect the adjustment element of the potentiometer 44 with the shell portion 50, so that manually turning the shell portions 50, 52 with respect to each other will thereby adjust the potentiometer—making the use of a screwdriver unnecessary.

Figure 9:
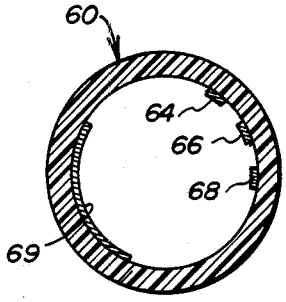
FIG. 9 is a cross-sectional view taken in the plane represented by lines 9—9 in FIG. 8.
Figure 10:
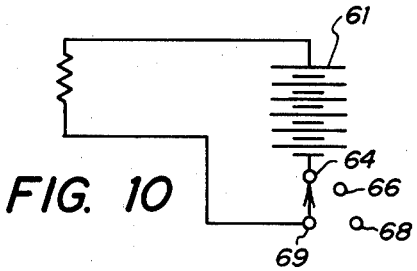
FIG. 10 is a schematic electrical circuit shown in FIG. 8.

FIGS. 8 and 9 illustrate still another embodiment of means for adjusting the current which flows through the electrical path that includes a person's lips. This embodiment 60 includes a plurality of DC voltage sources, i.e., a plurality of batteries 61. Additionally, a manual switch 62 is selectively movable between a plurality of terminals 64, 66, 68, 69. The current discharged through a person's lips will be a direct function of the number of DC voltage sources 61 that are connected in series by the switch 62. The electrical circuit for this embodiment 60 is shown schematically in FIG. 10.

Figure 11:
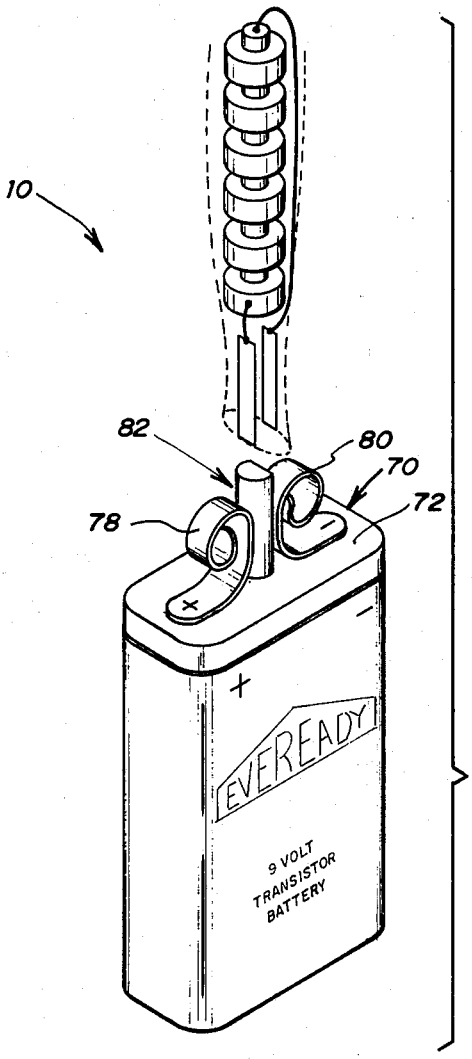
FIG. 11 is a perspective view of a device for permitting one dry cell battery to re-energize another dry cell battery contained within a cigarette holder.
Figure 13:
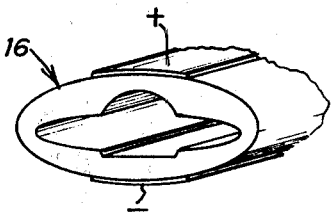
FIG. 13 is an end view of a cigarette holder having a mouthpiece adapted to engage a device as shown in FIG. 11, with the shape to be matched constituting a longitudinal section of a cylinder.

A distinct advantage of each of the embodiments disclosed herein is that the power sources are easily rechargeable, because the electrical conductors (through which the circuit is completed) are directly connected to the batteries. And, shown in FIG. 11 is a device which is particularly adapted for recharging a dry cell battery such as the relatively small batteries 18 contained within an anti-smoking device of the invention. The device 70 includes a base 72 on which are mounted a pair of polarized battery terminals 74, 76. The terminals 74, 76 are so oriented and so positioned as to foster easy connection with a conventional dry cell battery, such as a standard 9 volt transistor battery. That is, the terminal 74 has what is commonly referred to as a female configuration, and the terminal 76 has what is commonly referred to as a male configuration. Hence, it will be easy to merely snap the base 72 onto the top of a commercially available 9 volt transistor battery.

Figure 12:
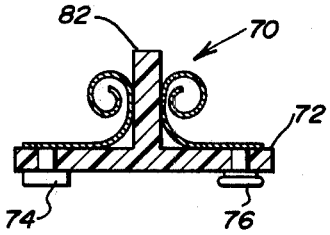
FIG. 12 is a front elevational view of the device shown in FIG. 11.

A pair of electrically conducting members 78, 80 are also mounted on said base 72, with respective ones of said members being in electrical contact with the pair of battery terminals 74, 76. As perhaps best seen in FIG. 12, the member 78 is positioned opposite battery terminal 74 and is in electrical contact therewith through the insulating base 72; similarly, the member 80 is in electrical contact with battery terminal 76.

A non-conductive structural means 82 is also affixed to the base 72. In the embodiment of FIG. 11, it lies between the electrically conducting members 78, 80. The structural means 82 is non-symmetrical (with respect to the base), so that a mating structure can be placed around said member with only a single orientation. The lip-contacting end of a cigarette holder will typically be provided with a configuration which matches that of means 82, so that the cigarette holder can only be placed adjacent the base in a manner which places like terminals of the internal batteries and the external battery into electrical contact. During the process of physically placing the cigarette holder next to the base 72, the electrically conducting members 78, 80 will come into contact with respective members 20, 22 of holder 10 or members 40, 42 of holder 30. Then, if the external (transistor) battery is more highly charged, it will provide part of its charge to the small dry cell batteries mounted within the cigarette holder. As may be readily seen in FIG. 11, a preferred configuration for the electrically conducting members 78, 80 is a generally coiled configuration; and said members 78, 80 will typically have the biasing characteristics of a coiled spring, whereby firm electrical contact between the members 78, 80 and respective conductive members on a cigarette holder can be repeatedly achieved.

Assuming that the batteries within a cigarette holder are of the type previously described, e.g., a 1.5 volt S13E battery, and, assuming that the "charging battery" is a fresh 9 volt transistor battery, said transistor battery should be able to re-energize the cigarette holder for a year or more—even if the cigarette holder was used frequently. Of course, silver oxide batteries (such as the S13E batteries) are not normally categorized as being rechargeable. And it may be true that they can never be recharged with the device 70 back to 100% of their original charge. But they can certainly be rejuvenated or re-energized to an appreciable extent, thereby prolonging the life of the anti-smoking device. And, using nickel-cadmium batteries or others that are classified as rechargeable would naturally render the endurance of the anti-smoking devices well beyond the period of time that should be required to break "the habit," if a person truly wants to stop smoking. In theory, though, the cigarette holder would not likely be used for more than a few days (or, at most, a few weeks), because of the subtraining characteristics of the invention, which will now be fully explained.

In operation of the invention, a person who is physically and mentally addicted to nicotine consumption, either through smoking cigarettes, cigars or a pipe, must first decide that he truly wishes to stop smoking. Having consciously decided this, however, the body chemistry of the inveterate smoker will typically be such that his sub-conscious conveys a requirement for nicotine consumption—the level of which is determined by his normal daily consumption and the elapsed time since his last nicotine intake. This sub-conscious "need" for nicotine can reach a degree, and the habit become so motorized, that a person can sometimes reach for a cigarette, put it in his mouth, light it, and be on the way to completing the cigarette before he suddenly becomes aware of the fact that he is again smoking. Hence, it is believed that if this habitual and almost automatic motor function is to be interrupted, it will most expeditiously be done by overcoming the subconscious desire to smoke with a conscious desire to stop. It is believed, further, that this is best accomplished by associating a mild physical discomfort with the sub-conscious desire for a fresh cigarette. And, the best physical discomfort that has been identified is electrical shock to the smoker's lips—which are appreciably more sensitive than most other portions of a person's exposed skin, such as his hands, arms, etc. By applying an electrical shock at a relatively low current level to a sensitive skin area, the risk of damage to a person's skin is practically eliminated. That is, passing current through a person's skin in the vicinity of his wrists in order to introduce a low level pain may require a flow of current so large as to result in some permanent tissue damage, which is typically manifested by blisters and the like being formed on the exterior of the skin.

With the present invention, a cigarette smoker who wishes to break his habit must only remember to place each cigarette he smokes into the forward end of a holder described above, in the same manner as he would load a conventional cigarette holder. (A pipe smoker would not even have to remember this step, since the stem of his pipe would carry an electrical apparatus like that shown in FIGS. 2 or 5, and there is no way he could by-pass the anti-smoking apparatus through oversight.) Immediately upon placing the holder between his lips, and well prior to even striking a match, the smoker will experience a mild physical discomfort due to the discharge of electricity from the source 18. Of course, the level of discharge should not be so terribly offensive as to cause the smoker to absolutely refuse to again put the holder in his mouth. (In such a case, he would simply discard the holder; and his well-intentioned program of breaking the habit of smoking would be thwarted.) Thus, an ideal amount of current would be enough to be perceptible and slightly uncomfortable—but not intolerable. When the smoker periodically removes the holder from his lips, there is no discharge of electrical energy, since the electrical path including elements 20, 22 is again open. The batteries, therefore, are not being discharged except when some conductor such as tissue is in contact with elements 20, 22. By the time a smoker has completed his first cigarette using the holder 10, he should have already begun to associate the act of smoking with some discomfort to his lips.

In due time, a smoker will normally be expected to reach for another cigarette. All that is required in this program is that he remember to again insert the next cigarette in the holder. By the time he has consumed his second cigarette, his lips will normally be even more sensitive to the discharge of current then they were when the holder was first used. This enhancing characteristic of the program, wherein the lips become more sensitized to electrical shock as the shock is repeated, begins to automatically lengthen the elapsed time between cigarettes. As the length of time between cigarettes is gradually increased, the body's physical need for nicotine gradually decreases. That is, the fewer cigarettes that a person smokes over an extended period of time, the lower will be his compulsion for those cigarettes. Eventually, if the smoker conscientiously uses the holder everytime he smokes a cigarette, he should find that he is more nearly able to completely avoid the consumption of nicotine.

Although each individual will probably experience his own unique rate of decline in his desire for cigarettes, it would not be unexpected for a program of anti-smoking "therapy" to eventually make it possible for a smoker to go for one or two days without feeling the need to smoke a cigarette. And, after his "body demand" for nicotine has declined to the point that he can go for two days without a cigarette, he will normally be near the conclusion of his therapy. The total length of time that it takes a smoker to drop from two packs a day to one cigarette every couple of days obviously cannot be determined by purely scientific or engineering considerations; it will inherently be determined by each individual, the level of electrical current he decides he can routinely tolerate, and the diligence with which he wishes to follow the instructions provided herein. It would not be unusual for the therapy program to take as long as a month.

Also, it has been experimentally found that women—as a class—tend to have lips that are much more sensitive to electrical shock than men's lips. Perhaps one reason that women's lips are more sensitive is that they tend to protect their lips from harmful rays of the sun and the elements (wind, snow, etc.) when they apply lipstick and the like as a cover or lubricant. But, if the device 10 is being used by a woman who is wearing lipstick at that time, her lipstick might possibly serve as an insulator against the planned electrical shock—if it is of the type which includes a high proportion of pigments. (Dark colored lipsticks which include substantial pigments have been found to be more insulative than relatively light colored lipsticks or lip glosses.) It will be understood, therefore, why a means for adjusting the level of current available from the DC source is highly desirable.

While only the preferred embodiments of the invention have been disclosed in great detail, it will be apparent to those skilled in the art that modifications thereof can be made without departing from the spirit of the invention. For example, it should be apparent that the normally open DC circuit disclosed herein could be easily incorporated into the stem of a pipe—instead of the illustrated cigarette holder. And, the circuit could be included in a pipe either during the original manufacture of that pipe or as an attachment that is adaptable to fit a smoker's well used pipe head. Because of the numerous variations in structural detail that are possible, it should be clearly understood that the invention should be limited only the claims that are appended hereto.

What is claimed is:

1. An anti-smoking device having utility in interfering with a person's desire to hold an object (such as a cigarette, cigar or pipe) between his lips, comprising:

a. a generally tubular shell of electrically non-conductive material and having first and second ends, with a first end being adapted to receive a tobacco-holding object, and the second end thereof including structure adapted to be held between a person's lips;

b. a DC voltage source of at least 6 volts but not much more than about 9 volts, with said voltage source being mounted within the tubular shell; and c. first and second electrically conductive members connected to the output of the DC source, with the distal ends of said conductive members extending alongside the lip-contacting structure of the tubular shell so that they may be readily touched by a person's lips, and the distal ends of said conductive members being about ¼ inch wide in the vicinity of the lip-contacting region, and the distal ends of said conductive members being separated so as to form a normally open electrical path, with one distal end being positioned to contact the upper lip and the other distal end being positioned to contact the lower lip, such that placing the lip-contacting structure between a person's lips will instantaneously close the electrical path without actuation of an ON/OFF switch, thereby resulting in the discharge of DC current from said source through the lips during the entire time that the tubular shell is held between the lips, and the lip-contacting end of each of the electrically conductive members having an area of at least 0.06 square inch, such that injury to a person's lips is precluded as a result of current flow of about 1–5 milliamps from said source.

2. An anti-smoking device having utility in interfering with a person's desire to hold an object (such as a cigarette, cigar or pipe) between his lips, comprising:

a. a generally tubular shell of electrically non-conductive material and having first and second ends, with a first end being adapted to receive a tobacco-holding object, and the second end thereof including structure adapted to be held between a person's lips;

b. a DC voltage source of at least 6 volts;

c. first and second electrically conductive members connected to the output of the DC source, with the distal ends of said conductive members extending alongside the lip-contacting structure so that they may be readily touched by a person's lips, and the distal ends of said conductive members being separated so as to form a normally open electrical path, with one distal end being positioned to contact the upper lip and the other distal end being positioned to contact the lower lip, such that placing the lip-contacting structure between a person's lips will instantaneously close the electrical path and result in the discharge of DC current from said source through the lips; and d. means for adjusting the current which flows from the DC source upon closing the electrical path so as to provide a current flow of about 1–5 milliamps, and said means including a potentiometer, one end of which is rigidly fixed to a first portion of the tubular shell, and further including a rotative element which is selectively positionable with respect to the tubular shell, whereby changing the relative position of the two elements will vary the amount of current which is available from said DC source.

3. An anti-smoking device having utility in interfering with a person's desire to hold an object (such as a cigarette, cigar or pipe) between his lips, comprising:

a. a generally tubular shell of electrically non-conductive material and having first and second ends, with a first end being adapted to receive a tobacco-holding object, and the second end thereof including structure adapted to be held between a person's lips;

b. a DC voltage source of at least 6 volts established by a plurality of DC voltage sources;

c. first and second electrically conductive members connected to the output of the DC source, with the distal ends of said conductive members extending alongside the lip-contacting structure so that they may be readily touched by a person's lips, and the distal ends of said conductive members being separated so as to form a normally open electrical path, with one distal end being positioned to contact the upper lip and the other distal end being positioned to contact the lower lip, such that placing the lip-contacting structure between a person's lips will instantaneously close the electrical path and result in the discharge of DC current from said source through the lips; and d. means for adjusting the current which flows from the DC source upon closing the electrical path so as to provide a current flow of about 1–5 milliamps, and said means including a switch which is selectively movable between a plurality of terminals that are connected to respective ones of the plurality of voltage sources, whereby the current discharged through a person's lips is a direct function of the number of DC voltage sources that are connected in series by the switch.

* * * * *